US007171956B2

(12) United States Patent
Igami et al.

(10) Patent No.: US 7,171,956 B2
(45) Date of Patent: Feb. 6, 2007

(54) EGR COOLER

(75) Inventors: Takazi Igami, Nagoya (JP); Toshimichi Kobayashi, Hadano (JP); Jyohei Yamamoto, Hadano (JP); Hiroshi Saitoh, Nagoya (JP)

(73) Assignee: T. Rad Co., Ltd., Tokyo (JP)

( * ) Notice: Subject to any disclaimer, the term of this patent is extended or adjusted under 35 U.S.C. 154(b) by 45 days.

(21) Appl. No.: 10/526,331

(22) PCT Filed: Jul. 31, 2002

(86) PCT No.: PCT/JP03/09775

§ 371 (c)(1),
(2), (4) Date: Feb. 28, 2005

(87) PCT Pub. No.: WO2004/020928

PCT Pub. Date: Mar. 11, 2004

(65) Prior Publication Data

US 2006/0130818 A1 Jun. 22, 2006

(30) Foreign Application Priority Data

Aug. 28, 2002 (JP) ..... 2002-249786
Sep. 17, 2002 (JP) ..... 2002-270395
May 23, 2003 (JP) ..... 2003-145967

(51) Int. Cl.
*F02M 25/07* (2006.01)
*F02B 47/08* (2006.01)
*F28F 9/02* (2006.01)
*F28F 1/08* (2006.01)

(52) U.S. Cl. ..... 123/568.12; 165/158; 165/177

(58) Field of Classification Search ..... 123/568.12; 60/320, 321, 605.2; 165/158–160, 175, 177, 165/179

See application file for complete search history.

(56) References Cited

U.S. PATENT DOCUMENTS 4,134,377 A * 1/1979 Bamsey et al. ..... 123/568.12
4,685,292 A * 8/1987 Brigham et al. ..... 60/320
5,251,693 A * 10/1993 Zifferer ..... 165/160
5,732,688 A * 3/1998 Charlton et al. ..... 123/568.12
6,311,678 B1 * 11/2001 Lepoutre ..... 123/568.12
6,360,532 B2 * 3/2002 Strahle et al. ..... 60/321
6,595,274 B2 * 7/2003 Hayashi et al. ..... 165/158
6,647,971 B2 * 11/2003 Vaughan et al. ..... 123/568.12

FOREIGN PATENT DOCUMENTS

JP 9-242548 9/1997
JP 11-505011 5/1999
JP 2002-168586 6/2002
WO WO 00/39517 7/2000

* cited by examiner

*Primary Examiner*—Willis R. Wolfe, Jr.
(74) *Attorney, Agent, or Firm*—Jordan and Hamburg LLP

(57) ABSTRACT

The present invention provides an EGR cooler that is easy to manufacture and can accelerate heat exchange. Round in section tubes are plastically deformed in one plane crossing centerlines thereof such that corrugated exhaust gas flow paths are formed inside the tubes.

6 Claims, 9 Drawing Sheets

EGR COOLER

TECHNICAL FIELD

The present invention relates to an exhaust gas recirculation apparatus (referred to below as an EGR cooler).

BACKGROUND ART

There is an EGR cooler where numerous, round in section, straight tubes are juxtaposed apart from one another, with both ends of the tubes communicating with headers and outer peripheries of the tubes being covered with a casing. This is a cooler that allows cooling water to circulate within the casing, allows exhaust gases to circulate within the tubes, and conducts heat exchange between both to cool the exhaust gases.

As another EGR cooler, an invention has been proposed in Japanese Patent Application Laid-Open Publication No. 2000-345925, in which plural spiral-shaped protrusions are formed on inner peripheral surfaces of the tubes so that the exhaust gases sufficiently contact the inner peripheral surfaces of the tubes.

Although it can to a certain extent be expected that conventional EGR cooler tubes having plural spiral-shaped protrusions formed on the inner surface sides thereof further improve contact between the exhaust gases and the inner peripheral surfaces of the tubes, it is difficult to say that the improvement is sufficient in and of itself.

Thus, it is an object of the present invention to provide an EGR cooler that can sufficiently agitate exhaust gases within tubes, accelerate heat exchange, and is easy to manufacture. Moreover, sometimes condensate liquid is generated within the tubes, and in this case it is an object of the invention to be able smoothly eliminate such condensate liquid.

DISCLOSURE OF THE INVENTION

The invention as defined in claim 1 provides an EGR cooler having a multiplicity of round in section tubes (1) which are juxtaposed spaced apart from each other, with both ends of the tubes (1) leading to a pair of headers (2), with exhaust gases (3) to be cooled circulating within the tubes (1), and with a cooling fluid (4) circulating around outer surfaces of the tubes (1), wherein the round in section tubes (1) are plastically deformed in one plane crossing centerlines of the tubes (1) such that corrugated exhaust gas flow paths are formed inside the tubes (1).

The invention as defined in claim 2 provides the EGR cooler of claim 1, wherein the centerlines of the tubes (1) are aligned with each other, with a multiplicity of recessed portions (5) being formed inward from the outer surfaces of the tubes (1) apart from each other in the longitudinal direction, with the multiplicity of recessed portions being arranged such that inner and outer surfaces of cross sections on the one plane are formed in mountain shapes and that ridgelines (5*a*) of top portions of the mountains are orthogonal to the one plane, wherein adjacent recessed portions (5) are formed at positions differing from each other by 180 degrees in the circumferential direction, and wherein both longitudinal-direction end portions of the tubes (1) are such that round portions (1*a*) are formed whose cross sections orthogonal to axial lines are round.

The invention as defined in claim 3 provides the EGR cooler of claim 1, wherein the tubes (1) comprise tubes of the same form whose centerlines are formed so as to corrugate within the one plane, with the tubes (1) being disposed in parallel so that phases of the wave forms of the tubes coincide with each other in each row.

The invention as defined in claim 4 provides the EGR cooler of claim 3, wherein the tubes (1) are disposed so that the phases of the waves in adjacent rows differ from each other by 180 degrees.

The invention as defined in claim 5 provides the EGR cooler of claim 3, wherein planes in the corrugated direction of the centerlines of the tubes (1) are disposed so as to be inclined at the same angle$\theta$ with respect to a horizontal plane (15).

The invention as defined in claim 6 provides the EGR cooler of claim 3, wherein the tubes (1) are formed so as to be face only one side on the plane in which the waves are directed due to balance of gravity of the entire tubes when undersurfaces of two spaced apart top portions of the wave forms of the centerlines are supported by plate members (6) that are orthogonal to the centerlines.

The invention as defined in claim 7 provides the EGR cooler of claim 3, wherein at undersurface sides of two spaced apart top portions of the wave forms of the centerlines of the tubes (1), the tubes (1) include tube support portions (7) formed in "V" shapes in section.

The invention as defined in claim 5 provides the EGR cooler of any one of claims 3 to 7, wherein the longitudinal-direction end portions of the tubes (1) have straight centerlines.

The EGR cooler of the invention comprises the above configuration and includes the following effects.

According to the invention recited in claim 1, the tubes 1 are plastically deformed in one plane crossing centerlines of the tubes 1, and exhaust gas flow paths are formed in wave forms. Thus, exhaust gases inside the tubes 1 are allowed to sufficiently corrugate, wind along and be agitated, so that heat exchange with the cooling fluid 4 at the outer surfaces of the tubes 1 can be promoted.

Also, because the plastically deformed portions are carried out in one plane crossing the centerlines, the round in section tubes can easily be plastically deformed by pressing or the like.

According to the invention recited in claim 2, numerous recessed portions (5) are formed by plastic deformation apart from each other in the longitudinal direction and the circumferential direction so as to corrugate inward from the outer surfaces of the tubes (1), cross sections of the recessed portions 5 are formed in mountain shapes, and ridgelines (5*a*) thereof are formed in a direction intersecting the centerlines of the tubes 1. Thus, the exhaust gases 3 circulating inside the tubes 1 are guided to the mountain shapes of the recessed portions 5, circulate in an undulating manner due to the ridgelines 5*a*, and are smoothly agitated without circulation resistance being increased that much, so that heat exchange can be promoted. In addition to this, the tubes 1 are configured so that it becomes difficult for clogging to occur.

Also, because the recessed portions 5 corrugate from the outer surfaces of the round in section tubes 1 due to plastic deformation, the manufacture thereof is easy.

Moreover, because the round portions 1*a* are formed at both end portions of the tubes 1, the air-tightness of the inserted portions of the headers 2 into which both ends of the tubes 1 are inserted can be secured.

Additionally, because the tubes 1 are basically round in section, their ability to withstand pressure is high and they can allow high-pressure exhaust gases 3 to circulate therein.

Also, because the recessed portions 5 are 180 degrees apart from each other in the circumferential direction, they allow the exhaust gases 3 to periodically undulate in wave forms so that heat exchange is further improved.

According to the invention recited in claim 3, the length of the entire heat converter can be shortened and the arrangement density of the tubes 1 can be made the same as that of straight pipes. That is, the length of the distance between both ends of the tubes 1 can be shortened in comparison to a case where straight pipes in which the lengths of the flow paths inside the tubes 1 are made the same are used.

Moreover, because the tubes 1 are of the same shape, where the centerlines are formed so as to corrugate in one plane, and are disposed in parallel so that the phases of the wave forms between the rows match, an EGR cooler that is compact and whose performance is excellent can be provided.

Also, the exhaust gases 3 circulating inside the tubes 1 and the fluid circulating around the outer surfaces of the tubes 1 are sufficiently agitated due to the wave forms of the tubes 1, so that heat exchange can be promoted.

According to the invention recited in claim 4, the agitation of the fluid at the outer surfaces of the tubes 1 is promoted so that heat exchange performance can be improved.

According to the invention of claim 5, condensate liquid generated inside the tubes 1 of the EGR cooler can be allowed to flow smoothly downward in the direction of inclination of the tubes 1. For this reason, there is no potential for condensate liquid to accumulate inside and corrode the tubes 1, and an EGR cooler having high durability can be provided.

Moreover, because the tubes 1 are formed so that the axial lines thereof corrugate, the exhaust gases 3 circulating inside the tubes 1 are agitated, the heat transfer area becomes wide, and heat exchange with the cooling fluid 4 can be promoted.

According to the invention recited in claim 6, the tubes can be juxtaposed in the same direction when numerous tubes 1 are disposed on the pair of plate members 6. That is, the tubes 1 are juxtaposed on the plate members 6 without being oriented in a direction offset from around the centerlines. Thus, when the EGR cooler is to be assembled, the corrugating planes are disposed in the same direction and the EGR cooler can be easily assembled.

According to the invention recited in claim 7, because the undersurfaces of the top portions of the tubes 1 are "V" shaped in section and include the support portions 7, the numerous tubes 1 can be numerously juxtaposed, with the corrugating planes thereof being maintained in the same direction, by the plate members 6 including the V-shaped support recesses 13 corresponding to the support portions 7. Thus, the EGR cooler can be easily assembled.

According to the invention recited in claim 8, the straight portions of both longitudinal-direction ends of the tubes 1 are inserted into the headers 2, so that the communicating portions thereof can be easily fixed so as to be airtight. That is, the air-tightness of the tube insertion portions between the tubes 1 and the headers 2 can be secured by the same method as tubes whose entire lengths are straight.

BEST MODE FOR CARRYING OUT THE INVENTION

Embodiments of the invention will now be described on the basis of the drawings.

Figure 1:
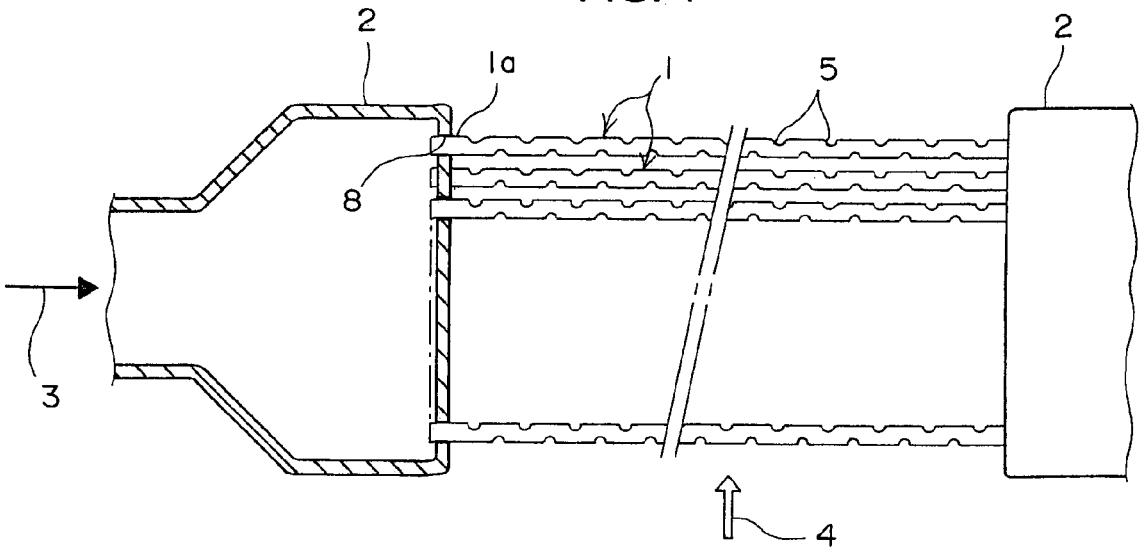
FIG. 1 is a partially cut-away plan view of an EGR cooler of the invention.
Figure 2:
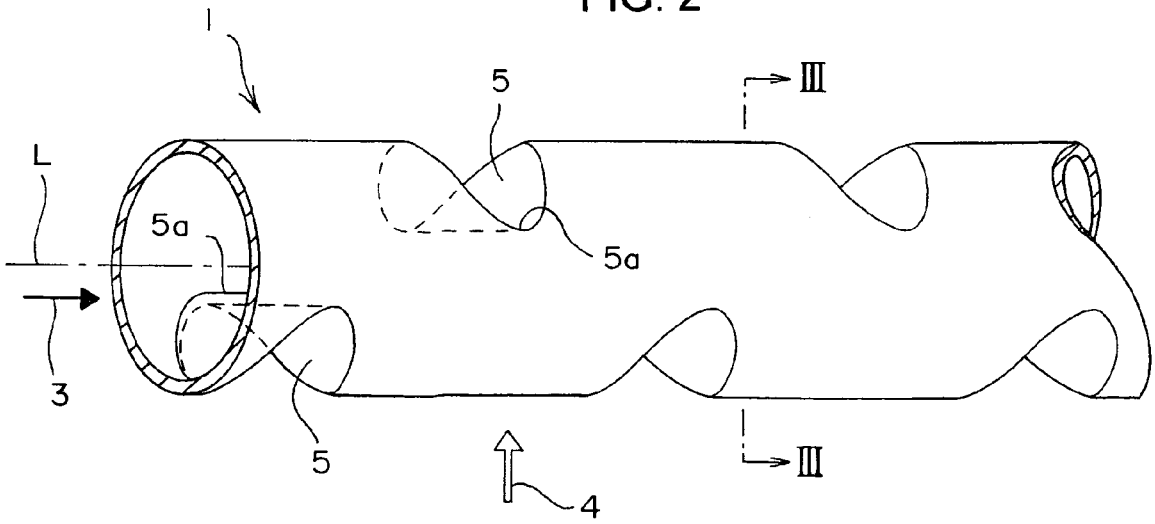
FIG. 2 is a perspective view of the main parts of a tube 1 used in the EGR cooler.
Figure 3:
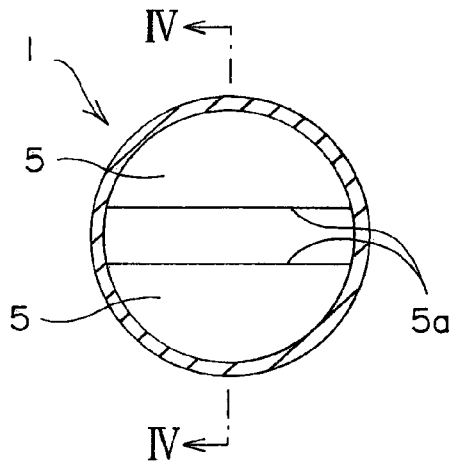
FIG. 3 is a cross-sectional view seen from arrow III—III of FIG. 2.
Figure 4:
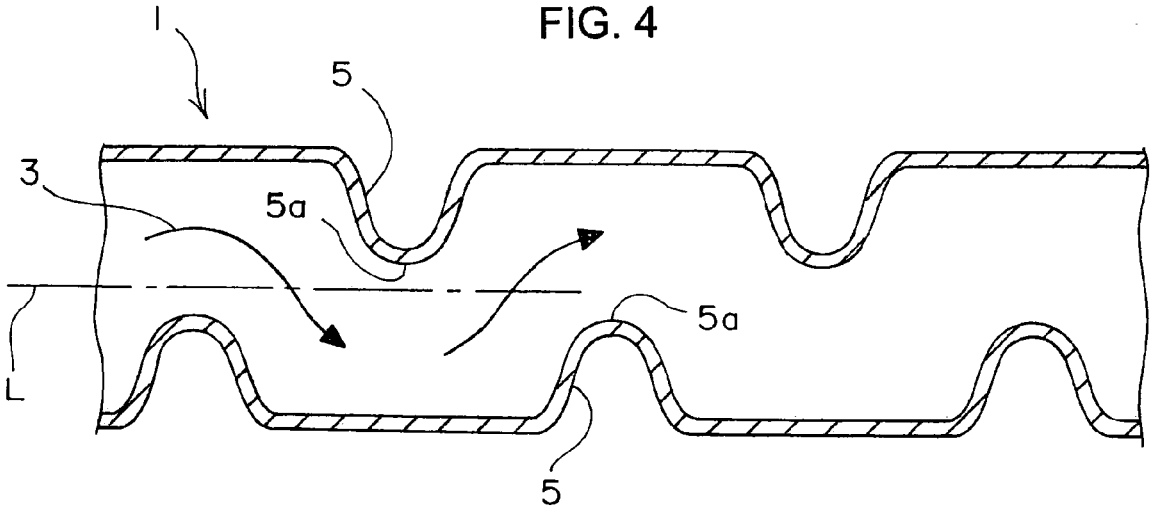
FIG. 4 is a cross-sectional view seen from arrow IV—IV of FIG. 3.

FIG. 1 is a partially cut-away plan view of an EGR cooler of the invention, FIG. 2 is a perspective view of the main parts of a tube 1 used in the EGR cooler, FIG. 3 is a cross-sectional view seen from arrow III—III of FIG. 2, and FIG. 4 is a cross-sectional view seen from arrow IV—IV of FIG. 3.

The EGR cooler is an apparatus where numerous tubes 1 are juxtaposed at fixed intervals apart from each other, with both ends of each tube 1 communicating with a pair of headers 2. Exhaust gases 3 flow into the tubes 1 from one header 2 and are guided to the other header 2. A cooling fluid 4, such as cooling water or cooling air, circulates around the outer peripheries of the tubes 1 to thereby cool the exhaust gases 3.

As shown in FIGS. 2 to 4, the tubes 1 are round in section and include numerous recessed portions 5 formed apart from each other in the longitudinal direction and the circumferential direction of the tubes 1. Adjacent recessed portions 5 are spaced apart by 180 degrees in the circumferential direction. As shown in FIG. 4, each recessed portion 5 is such that inner and outer surfaces of a cross section parallel to a centerline L corrugate in mountain shapes, with ridgelines 5*a* of the tops of the mountains being orthogonal to the centerline L.

The recessed portions 5 are not present at either of the longitudinal-direction ends of the tubes 1. Rather, a round portion 1*a* is formed at both longitudinal-direction ends of the tubes 1. The round portions 1*a* are inserted into round holes 8 in the headers 2. The inserted portions are joined, so as to be airtight, by soldering or welding.

In a state where the heat converter is installed, the ridgelines 5*a* of the recessed portions 5 are positioned in the direction of gravity. Thus, no recesses or protrusions are allowed to be formed at the undersurface sides of the tubes 1, whereby condensed water accumulating inside the tubes can be removed to the outside.

As shown in FIG. 1, the cooling liquid 4 circulates in the direction orthogonal to the centerlines L of the tubes 1. Also, the exhaust gases 3 circulating within the tubes 1 circulate and are agitated in an undulating manner due to the presence of the numerous recessed portions 5, whereby heat exchange with the cooling fluid 4 is promoted.

It should be noted that the cooling fluid 4 circulating around the outer surfaces of the tubes 1 is also agitated due to the presence of the recessed portions 5, whereby heat exchange is promoted.

Figure 5A:
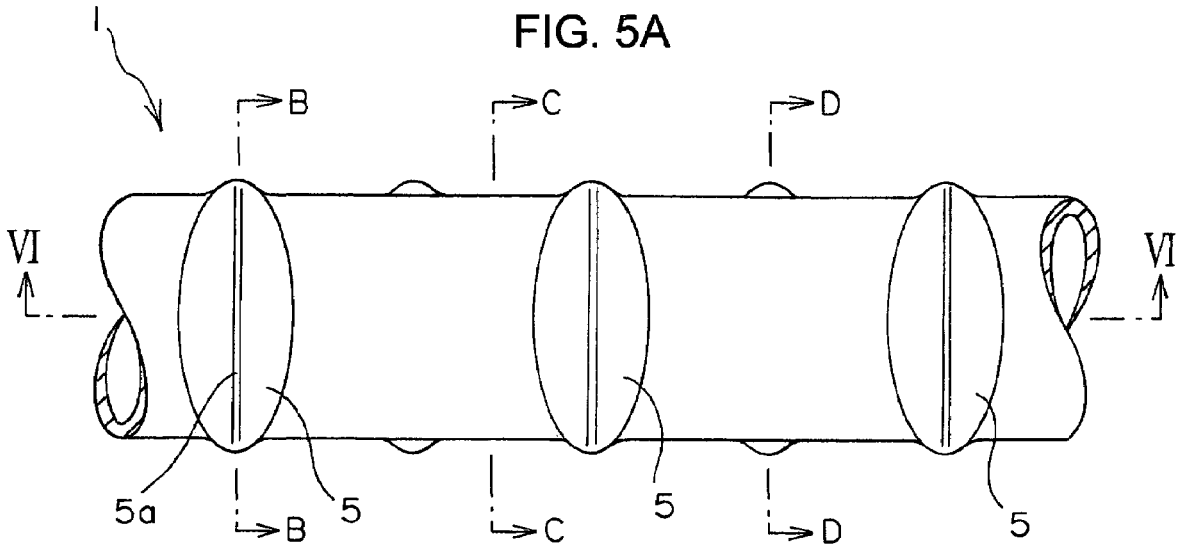
FIG. 5A to FIG. 5D show another example of the tube 1 used in the EGR cooler, with FIG. 5A being a front view thereof and FIG. 5B to FIG. 5D being cross-sectional views respectively seen from arrows B—B, C—C and D—D of FIG. 5A.
Figure 5B:
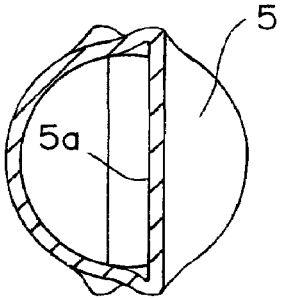
Figure 5C:
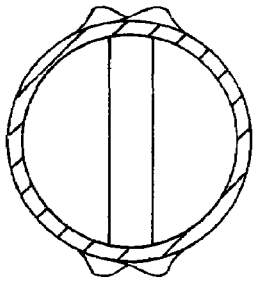
Figure 5D:
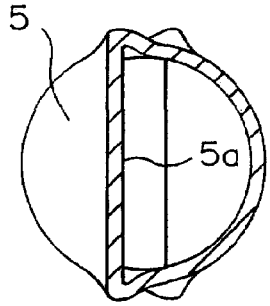
Figure 6:
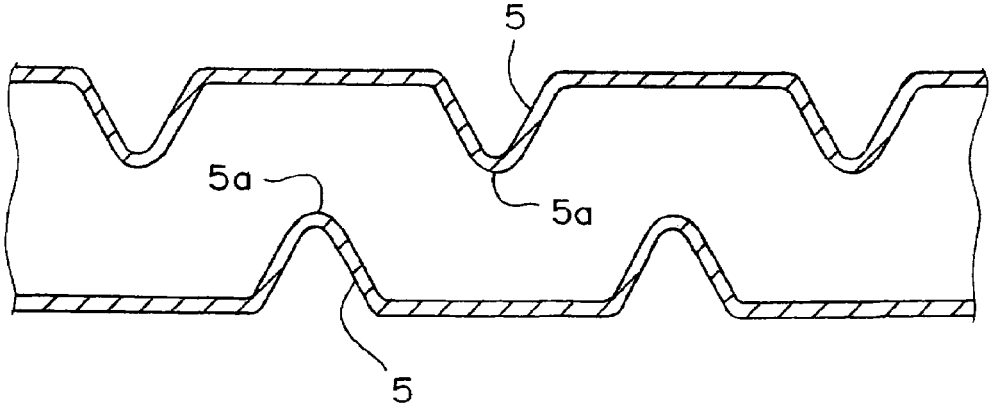
FIG. 6 is a schematic cross-sectional view seen from arrow VI—VI of FIG. 5A.

FIG. 5A to FIG. 5D and FIG. 6 illustrate another example of the tubes 1 used in the EGR cooler of the invention. FIG. 5A is a front view thereof, and FIG. 5B to FIG. 5D are cross-sectional views respectively seen from arrows B—B, C—C and D—D of FIG. 5A. FIG. 6 is a cross-sectional schematic view seen from arrow VI—VI of FIG. 5A.

This example is different from the one shown in FIGS. 2 to 4 in terms of the shape of the recessed portions 5. The recessed portions 5 in this example have a shape where the maximum diameter thereof is larger than the diameters of the tubes 1, the cross-section at the ridgeline 5*a* is slightly larger than a semicircle and both ends of the ridgeline 5*a* have been slightly spread open. In this case, the exhaust gases 3 circulating within the tubes 1 can be spread in the ridgeline direction at the recessed portions 5, whereby the agitation of the fluid can be promoted and heat exchange can be improved.

Figure 7:
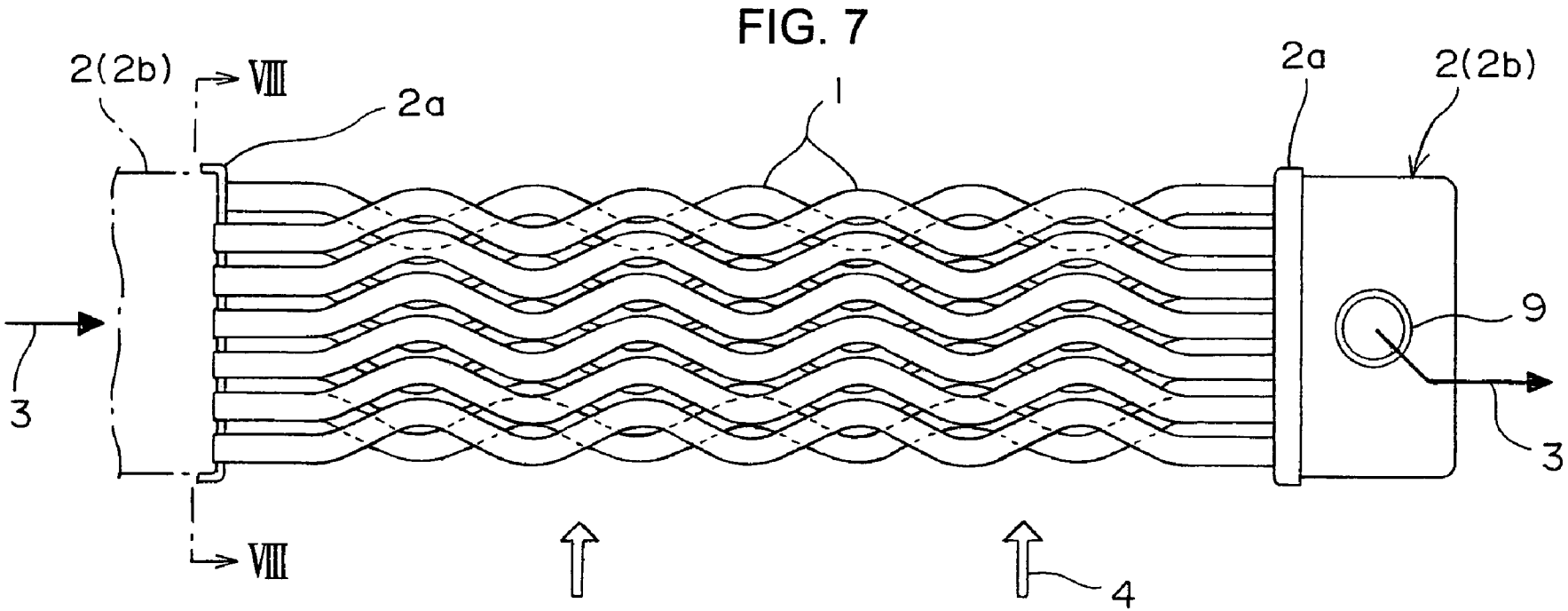
FIG. 7 is a partially cut-away plan view of an EGR cooler representing another embodiment of the invention.
Figure 8:
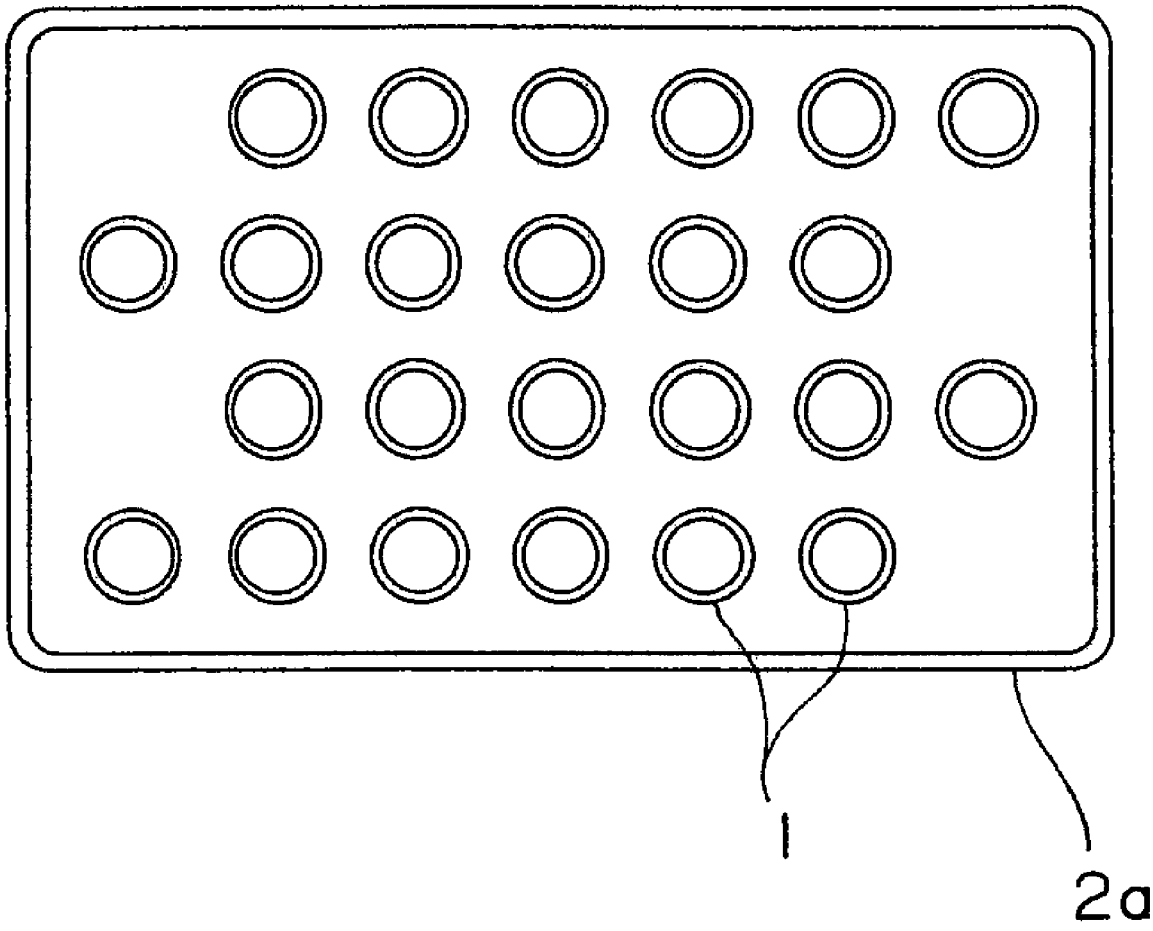
FIG. 8 is a view seen from arrow VIII—VIII of FIG. 7.

FIG. 7 is a plan view (partially cut-away) of a second embodiment of the EGR cooler of the invention, and FIG. 8 is a view seen from arrow VIII—VIII of FIG. 7.

This EGR cooler comprises tubes 1 of the same shape, in which the centerlines of the tubes 1 are formed so as to corrugate within one plane excluding both end portions of the tubes 1. Additionally, the centerlines of both longitudinal-direction end portions of the tubes 1 are formed straightly. Both end portions of the tubes 1 are inserted into tube insertion holes of a pair of header plates 2*a*, and the inserted portions are fixed therein so as to be airtight.

The header plates 2*a* close off the openings of header bodies 2*b*, and the headers 2 are formed by the header plates 2*a* and the headers bodies 2*b*.

The wave forms of the tubes 1 in each row are disposed in parallel, as shown in FIG. 7, so that the phases thereof match. Also, vertically adjacent tubes 1 of the rows are disposed so that the phases of the waves differ 180 degrees.

It should be noted that an exhaust gas outlet pipe 9 is disposed in the right-side header 2.

In the EGR cooler configured in this manner, the exhaust gas 3 flows into the tubes 1 from an entry pipe in the left-side header 2 in FIG. 7, circulates within the tubes 1, and is guided to the outside through the exhaust gas outlet pipe 9 of the other header 2. The cooling fluid 4 comprising cooling water or cooling air circulates parallel to the corrugating planes of the tubes 1, and the exhaust gases 3 inside the tubes 1 are cooled by the cooling fluid 4.

The exhaust gases 3 are guided and agitated in wave forms inside the tubes 1, heat exchange with the cooling fluid 4 is promoted, and soot adhering to the insides of the tubes 1 is broken away by this agitation and prevented from closing off the insides of the tubes 1. Also, because the cooling fluid 4 circulates parallel to the corrugating planes of the tubes 1, the cooling fluid 4 is itself also agitated so that heat exchange with the exhaust gases 3 can be promoted.

Figure 9:
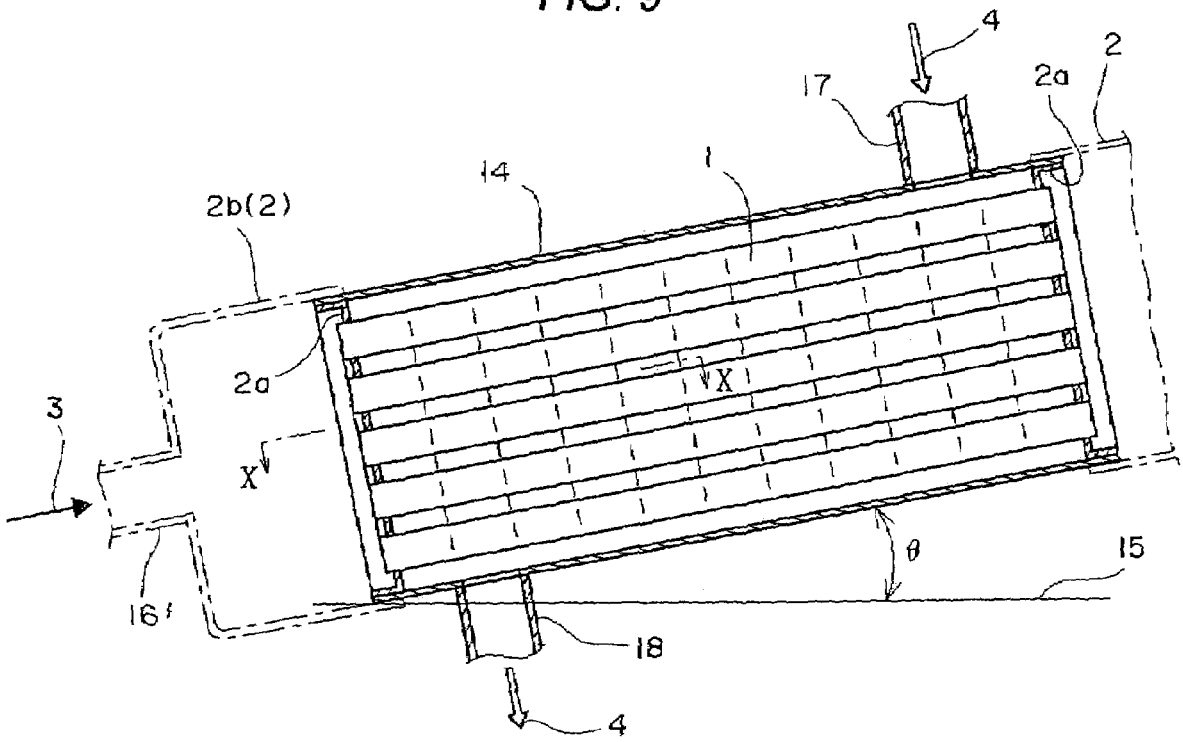
FIG. 9 is a partial front view of main parts showing yet another embodiment of the EGR cooler of the invention.
Figure 10:
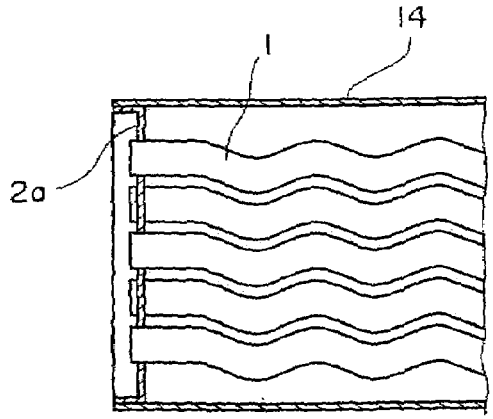
FIG. 10 is a view seen from arrow X—X of FIG. 9.

FIG. 9 is a cross-sectional front view of main parts showing another embodiment of the EGR cooler of the invention, and FIG. 10 is a view seen from arrow X—X of FIG. 9.

Similar to the EGR cooler of FIG. 7, this EGR cooler comprises tubes 1 of the same shape where the centerlines of the tubes 1 corrugate. The tubes 1 are disposed in parallel so that the phases of the wave forms of the tubes 1 match in each row.

The things that are different from the example of FIG. 7 are that the outer periphery of the aggregate of the numerous tubes 1 is fitted in a casing 4 and the phases of the waves of the tubes 1 in all of the rows match. That is, the tubes 1 of the upper level and the tubes 1 of the lower level corrugate in the same direction. Additionally, as shown in FIG. 9, the entirety is disposed so as to be inclined at an angle of θ with respect to a horizontal plane 15.

The tubes 1 are such that the surfaces thereof are inclined at the angle of θ with respect to the horizontal plane 15 in a state where the surfaces in the corrugated direction of the tubes 1 are horizontally retained. Thus, condensate liquid generated inside the tubes 1 flows smoothly downward in the direction of inclination. Thus, there is no potential for condensate liquid to accumulate inside and corrode the tubes 1.

Figure 11:
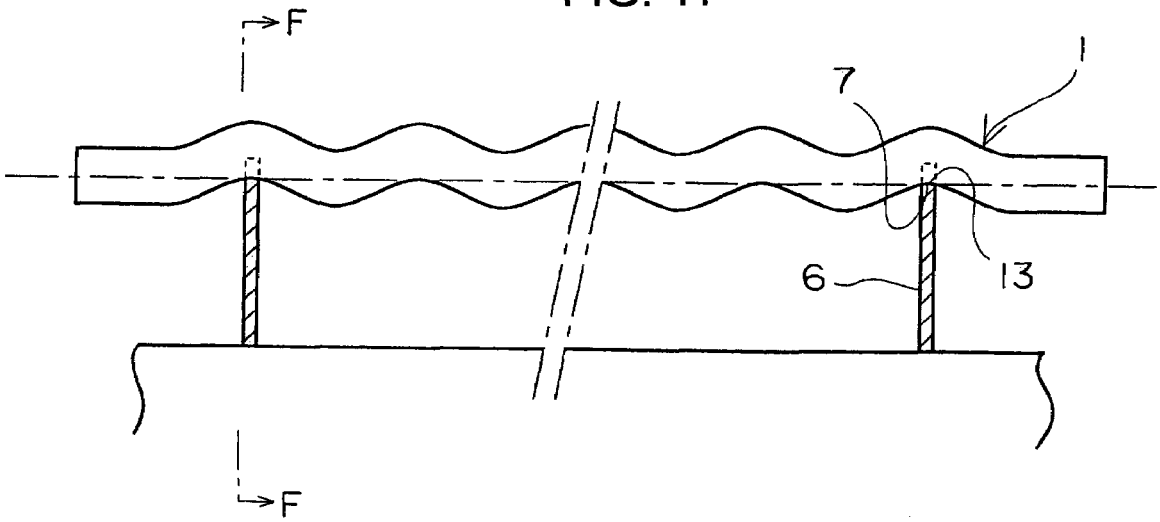
FIG. 11 is a front view showing a state where a pair of plate members 6 are juxtaposed prior to assembly of the tube 1 used in the EGR cooler.

The details of the tubes 1 are formed as shown in FIG. 11.

Figure 12:
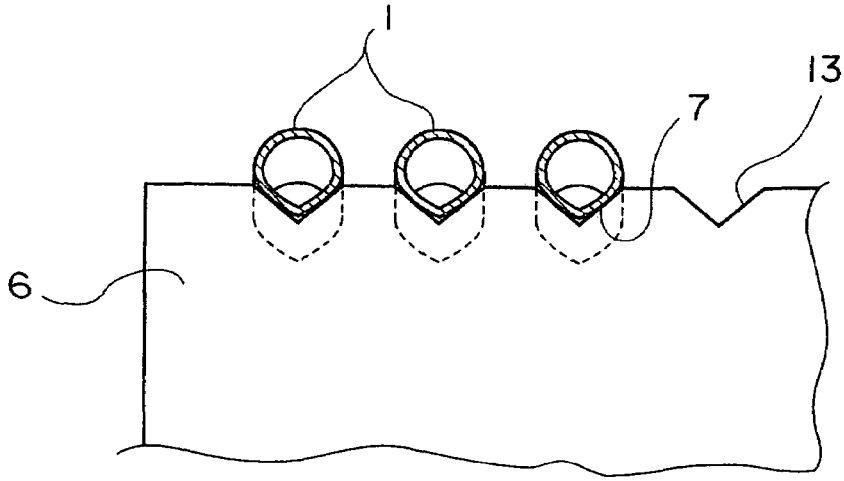
FIG. 12 is a view seen from arrow XII—XII of FIG. 11.

When undersurfaces 11 of the top portions 10 of the tubes 1 are supported by a pair of plate members 6, the tubes 1 are arranged in the positions of FIGS. 11 and 12 so that assembly of the heat converter is easily conducted. In this case, as shown in FIG. 11, a centerline $L_1$ of both end portions of each tube 1 is positioned lower than a centerline $L_0$ of the overall waves. For this reason, each tube 1 is stably maintained in the state shown in FIG. 11 by the balance of gravity.

In a case where, as shown in FIG. 11, the tubes 1 are supported by the pair of plate members 6 and $L_1$ is positioned lower than $L_0$, the positional energy of the tubes 1 is at the most stable low position. For this reason, the tubes 1 are stable in the orientation shown in FIG. 11 and there is no potential for the tubes to be inadvertently rotated.

Figure 13:
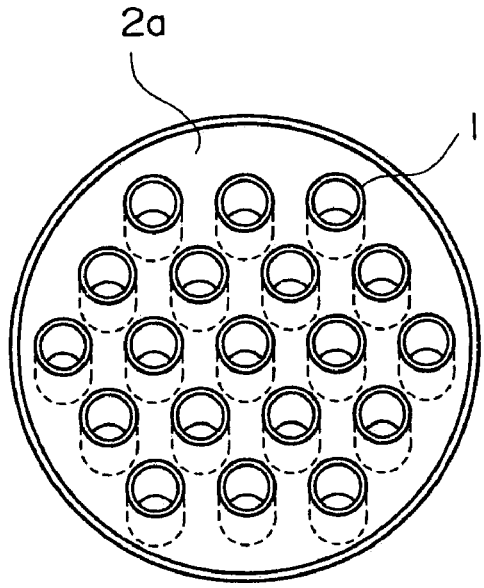
FIG. 13 is an explanatory view showing a state where the tubes used in the EGR cooler are attached to header plates 2*a;*

In the event that $L_1$ is higher than $L_0$, positional energy becomes high overall, the tubes 1 are affected by gravity, move to a lower position and are stabilized in the state shown in FIG. 11. As a result, the numerous tubes 1 are juxtaposed with the same orientation on the plate members 6 as shown in FIG. 12. By juxtaposing the tubes 1 in this manner, the assembly of the EGR cooler is facilitated. That is, when the EGR cooler is to be assembled, the orientations of the tubes 1 are made the same and, as shown in FIG. 13, the tubes 1 can be juxtaposed in the tube insertion holes of the header plates 2*a*. In this example, the corrugated directions of the waves of the tubes 1 are vertically positioned so that all of the tubes can be juxtaposed.

Figure 14:
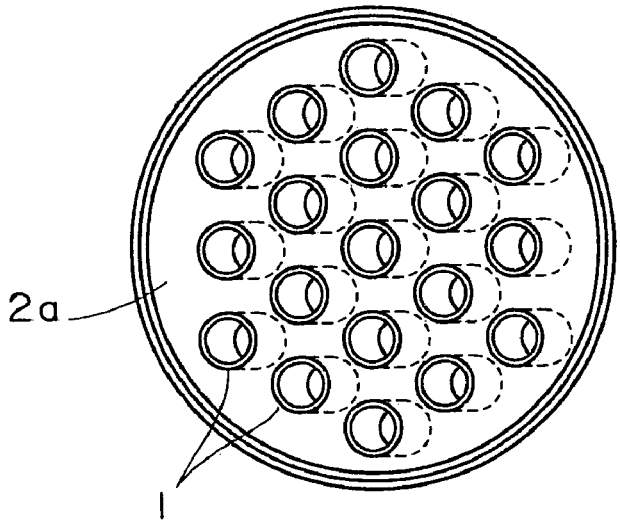
FIG. 14 is an explanatory view showing a state of use of the tubes 1 attached to the header plates 2*a;*

Next, the overall assembly is rotated 90 degrees and positioned as shown in FIG. 14, the corrugating planes of the tubes 1 are horizontally positioned and the entire cooler is inclined at the angle θ with respect to the horizontal plane 15 as shown in FIG. 9, whereby condensate liquid generated at the inner surfaces of the tubes 1 flows smoothly downward and can be prevented from accumulating inside the tubes 1.

Figure 15:
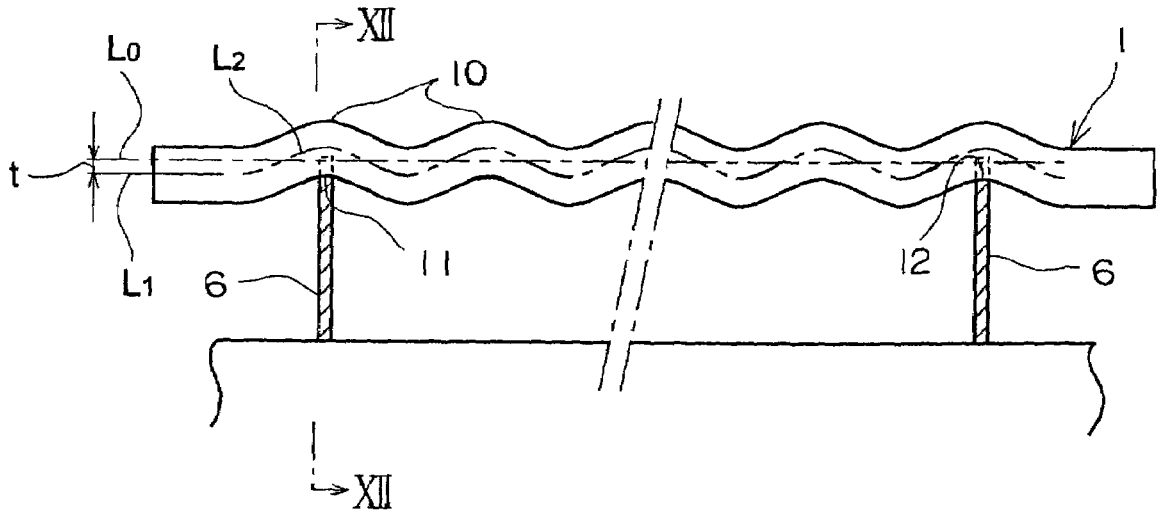
FIG. 15 is a front view showing a juxtaposed support state of other tubes 1 used in the EGR cooler.
Figure 16:
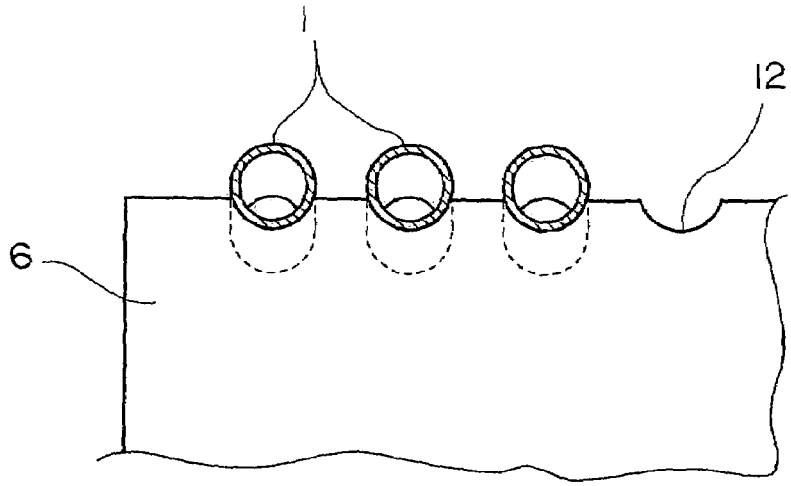
FIG. 16 is a cross-sectional view seen from arrow F—F of FIG. 15.

FIGS. 15 and 16 show another embodiment of the tubes 1. This example is different from the example of FIGS. 11 and 12 in that the cross-sections of the tubes 1 are formed in "V" shapes at the points where the tubes are supported by the plate members 6. Also, numerous V-shaped support recesses 13 are juxtaposed apart from each other in the plate members 6 so as to correspond to the tubes 1.

In this case also, all of the juxtaposed tubes 1 can be oriented in the same direction by the V-shaped support recesses 13 and support portions 7.

What is claimed is:

1. An EGR cooler comprising a multipicity of round in section tubes which are juxtaposed spaced apart from each other, with both ends of the tubes leading to a pair of headers, with exhaust gases to be cooled circulating within the tubes, and with a cooling fluid circulating around outer surfaces of the tubes, wherein the round in section tubes are plastically deformed in one plane crossing centerlines of the tubes such that corrugated exhaust gas flow paths are formed inside the tubes; and wherein the centerlines of the tubes are aligned with each other, with a multiplicity of recessed portions being formed inward from the outer surfaces of the tubes apart from each other in the longitudinal direction, with the multiplicity of recessed portions being arranged such that inner and outer surfaces of cross sections on the one plane are formed in mountain shapes and that ridgelines of top portions of the mountains are orthogonal to the one plane, wherein adjacent recessed portions are formed at positions differing from each other by 180 degrees in the circumferential direction, and wherein both longitudinal-direction end portions of the tubes are such that round portions are formed whose cross sections orthogonal to axial lines are round.

2. An EGR cooler comprising a multiplicity of round in section tubes which are juxtaposed spaced apart from each other, with both ends of the tubes leading to a pair of headers, with exhaust gases to be cooled circulating within the tubes, and with a cooling fluid circulating around outer surfaces of the tubes, wherein the round in section tubes are plastically deformed in one plane crossing centerlines of the tubes such that corrugated exhaust gas flow paths are formed inside the tubes;

wherein the tubes comprise tubes of the same form whose centerlines are formed so as to corrugate within the one plane, with the tubes being disposed in parallel so that phases of the wave forms of the tubes coincide with each other in each row; and wherein the tubes are disposed so that the phases of the waves in adjacent rows differ from each other by 180 degrees.

3. An EGR cooler comprising a multiplicity of round in section tubes which are juxtaposed spaced apart from each other, with both ends of the tubes leading to a pair of headers, with exhaust gases to be cooled circulating within the tubes, and with a cooling fluid circulating around outer surfaces of the tubes, wherein the round in section tubes are plastically deformed in one plane crossing centerlines of the tubes such that corrugated exhaust gas flow paths are formed inside the tubes;

wherein the tubes comprise tubes of the same form whose centerlines are formed so as to corrugate within the one plane, with the tubes being disposed in parallel so that phases of the wave forms of the tubes coincide with each other in each row; and wherein planes in the corrugated direction of the centerlines of the tubes are disposed so as to be inclined at the same angle θ with respect to a horizontal plane.

4. An EGR cooler comprising a multiplicity of round in section tubes which are juxtaposed spaced apart from each other, with both ends of the tubes leading to a pair of headers, with exhaust gases to be cooled circulating within the tubes, and with a cooling fluid circulating around outer surfaces of the tubes, wherein the round in section tubes are plastically deformed in one plane crossing centerlines of the tubes such that corrugated exhaust gas flow paths are formed inside the tubes;

wherein the tubes comprise tubes of the same form whose centerlines are formed so as to corrugate within the one plane, with the tubes being disposed in parallel so that phases of the wave forms of the tubes coincide with each other in each row; and wherein the tubes are formed so as to be face only one side on the plane in which the waves are directed due to balance of gravity of the entire tubes when undersurfaces of two spaced apart top portions of the wave forms of the centerlines are supported by plate members that are orthogonal to the centerlines.

5. An EGR cooler comprising a multiplicity of round in section tubes which are juxtaposed spaced apart from each other, with both ends of the tubes leading to a pair of headers, with exhaust gases to be cooled circulating within the tubes, and with a cooling fluid circulating around outer surfaces of the tubes, wherein the round in section tubes are plastically deformed in one plane crossing centerlines of the tubes such that corrugated exhaust gas flow paths are formed inside the tubes;

wherein the tubes comprise tubes of the same form whose centerlines are formed so as to corrugate within the one plane, with the tubes being disposed in parallel so that phases of the wave forms of the tubes coincide with each other in each row; and wherein at undersurface sides of two spaced apart top portions of the wave forms of the centerlines of the tubes, the tubes include tube support portions formed in "V" shapes in section.

6. The EGR cooler of any one of claims 2 to 5, wherein the longitudinal-direction end portions of the tubes have straight centerlines.

* * * * *